US008019238B2

(12) United States Patent
Okuda et al.

(10) Patent No.: US 8,019,238 B2
(45) **Date of Patent: *Sep. 13, 2011**

(54) IMAGE FORMING APPARATUS

(75) Inventors: Fumitoshi Okuda, Yatomi (JP); Seijiro Kadowaki, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 400 days.

This patent is subject to a terminal disclaimer.

(21) Appl. No.: 12/211,898

(22) Filed: Sep. 17, 2008

(65) Prior Publication Data

US 2009/0080908 A1 Mar. 26, 2009

(30) Foreign Application Priority Data

Sep. 25, 2007 (JP) ..... 2007-247198

(51) Int. Cl.
*G03G 15/00* (2006.01)

(52) U.S. Cl. ..... 399/26; 399/9; 399/36; 399/163; 399/167

(58) Field of Classification Search ..... 399/9, 26, 399/36, 163, 167
See application file for complete search history.

(56) References Cited

U.S. PATENT DOCUMENTS

| | | | | |
|---|---|---|---|---|
| 5,444,525 | A | 8/1995 | Takahashi et al. | |
| 6,330,404 | B1 | 12/2001 | Munenaka et al. | |
| 6,493,533 | B1 | 12/2002 | Munakata | |
| 7,215,907 | B2 * | 5/2007 | Fukuchi et al. | 399/167 |
| 7,561,830 | B2 * | 7/2009 | Watahiki | 399/167 |
| 7,564,473 | B2 | 7/2009 | Nomura et al. | |
| 2006/0284967 | A1 | 12/2006 | Nomura et al. | |
| 2007/0258729 | A1 * | 11/2007 | Ehara et al. | 399/167 |
| 2009/0074429 | A1 | 3/2009 | Abe | |
| 2009/0080006 | A1 | 3/2009 | Aoki | |
| 2009/0190945 | A1 | 7/2009 | Nomura et al. | |

FOREIGN PATENT DOCUMENTS

| | | |
|---|---|---|
| JP | 05-150574 | 6/1993 |
| JP | 06-110272 A | 4/1994 |
| JP | 07-199576 | 8/1995 |
| JP | 07-225544 | 8/1995 |
| JP | 09-081006 | 3/1997 |
| JP | 2000-199988 | 7/2000 |

(Continued)

OTHER PUBLICATIONS

JP Office Action dtd Sep. 15, 2009, JP Appln. 2007-247198, English Translation.

(Continued)

*Primary Examiner* — David M Gray
*Assistant Examiner* — Joseph S Wong
(74) *Attorney, Agent, or Firm* — Banner & Witcoff, Ltd.

(57) ABSTRACT

In an image forming apparatus, an image forming portion forms an image on a rotator. A storage portion stores change characteristics information relevant to correction parameters corresponding to phase points of the rotator. A designating portion designates a correction parameter from the correction parameters based on the change characteristics information. A correcting portion corrects an image forming position on the rotator based on the correction parameter designated by the designating portion. When a first determining portion determines, based on a detecting phase point of the rotator detected by a detecting portion, that the current phase of the rotator corresponds to a shifting phase point, and further a second determining portion determines that the image forming portion is in inactive time, the designation by said designating portion is shifted to the correction parameter corresponding to the shifting phase point.

20 Claims, 11 Drawing Sheets

FOREIGN PATENT DOCUMENTS

| | | | |
|---|---|---|---|
| JP | 2000-284561 | | 10/2000 |
| JP | 2000-356875 | | 12/2000 |
| JP | 2001-005364 | | 1/2001 |
| JP | 2001-083760 | A | 3/2001 |
| JP | 2003-263089 | A | 9/2003 |
| JP | 2006-350046 | A | 12/2006 |
| JP | 2007-057954 | A | 3/2007 |

OTHER PUBLICATIONS

Japanese Office Action dated Sep. 15, 2009 in Application No. JP2007-242531 and partial English translation thereof.

Japanese Office Action dated Sep. 15, 2009 in Application No. JP2007-247209 and partial English translation thereof.

* cited by examiner

FIG.5

| ADDRESS (N) | CORRECTION DIFFERENCE Δ D(N) (expressed as time) |
|---|---|
| 0 | Δ D(0) (determined as D(0)-D(M)) |
| 1 | Δ D(1) (determined as D(1)-D(0)) |
| 2 | Δ D(2) (determined as D(2)-D(1)) |
| 3 | Δ D(3) (determined as D(3)-D(2)) |
| 4 | Δ D(4) (determined as D(4)-D(3)) |
| ... | ... |
| M | Δ D(M) (determined as D(M)-D(M-1)) (final data) |

IMAGE FORMING APPARATUS

CROSS REFERENCE TO RELATED APPLICATION

The present application claims priority from Japanese Patent Application No. 2007-247198 filed Sep. 25, 2007. The entire content of this priority application is incorporated herein by reference.

TECHNICAL FIELD

The present disclosure relates to an image forming apparatus.

BACKGROUND

An image forming apparatus includes a rotator such as a photoconductor or a paper conveyer roller, so as to form an image on the rotator or on a recording medium traveling via rotation of the rotator. In an electrophotographic printer, for example, an electrostatic latent image is formed on a rotating photoconductor by optical scanning, and thereafter is developed and transferred to a recording medium.

If the photoconductor rotates at a constant speed, line scanning at a constant time interval enables a proper image (as an electrostatic latent image, or a developed or transferred image), in which the scanning line interval is uniform.

However, the photoconductor actually has cyclic variation in rotational speed. This could result in an odd image, in which the scanning line interval has variation. Thus, image quality may be degraded due to the rotational variation of the photoconductor. In view of this, it is proposed that an image forming apparatus has a function for suppressing variation in scanning line interval caused by variation in rotational speed of the photoconductor.

In the image forming apparatus, correction amounts corresponding to some phase points of rotation of the photoconductor are preliminarily measured, and the measurements are stored in a memory. The correction amounts are amounts of time used for correcting the scanning line interval at the respective phase points into a predetermined reference interval.

Specifically, the image forming apparatus starts line scanning of the rotating photoconductor, in response to an instruction for image formation. During the line scanning, the image forming apparatus regularly estimates the current phase of rotation of the photoconductor, based on detection of the origin phase of the photoconductor by an origin sensor, and further based on an internal clock provided therein.

The above correction amounts are sequentially retrieved according to the estimated current phase. Thereby, the starting time for each scanning line is corrected based on the retrieved correction amounts, so that the scanning line interval is consistently adjusted to the reference line interval.

However, the current phase, estimated based on the detected origin phase and the internal clock as described above, is not necessarily consistent with the actual current phase of the photoconductor. Further, the difference between the estimated current phase and the actual current phase may increase over the cycles of rotation of the photoconductor.

Consequently, the correction amount corresponding to a phase point substantially different from the actual current phase may be retrieved and used for correction, resulting in false correction. Thus, there is a problem that the effect of variation in rotational speed of the rotator cannot be adequately suppressed. This problem can occur with printers other than an electrophotographic printer, such as an ink-jet printer.

Thus, there is a need in the art to provide an image forming apparatus capable of suppressing the effect of variation in rotational speed of a rotator on image quality.

SUMMARY

An image forming apparatus according to an aspect of the present invention includes an image forming portion, a storage portion, a designating portion, a correcting portion, a detecting portion, a first determining portion, a second determining portion and a shifting portion.

The image forming portion has a rotator, and is configured to form an image on the rotator or a recording medium traveling via rotation of the rotator. The storage portion is configured to store change characteristics information relevant to correction parameters corresponding to phase points of the rotator.

The designating portion is configured to designate a correction parameter from the correction parameters based on the change characteristics information. The correcting portion is configured to correct an image forming position on the rotator or the recording medium based on the correction parameter designated by the designating portion.

The detecting portion is configured to detect that the rotator has reached a detecting phase point. The first determining portion is configured to determine, based on the time when the detecting portion detects the detecting phase point of the rotator, whether the current phase of the rotator corresponds to a shifting phase point. The second determining portion is configured to determine whether the image forming portion is in inactive time.

The shifting portion is configured to shift the designation by the designating portion to the correction parameter corresponding to the shifting phase point, when the first determining portion determines that the current phase of the rotator corresponds to the shifting phase point and the second determining portion determines that the image forming portion is in inactive time.

According to the present invention, a correction parameter from the correction parameters is designated by the designating portion based on the change characteristics information, and an image forming position on the rotator or the recording medium is corrected based on the designated correction parameter.

When it is determined, based on detection of the rotator having reached the detecting phase point, that the current phase of the rotator corresponds to the shifting phase point, the designation by the designating portion is shifted to the correction parameter corresponding to the shifting phase point which exactly or approximately coincides with the actual current phase of the rotator. Consequently, the effect of variation in rotational speed of the rotator on image quality can be suppressed adequately.

Further, according to the present invention, the above shift of the designation at the shifting phase point is allowed while the image forming portion is in inactive time. That is, the shift of the designation is skipped while the image forming portion is in active time, even if the rotator has reached the shifting phase point.

Thereby, abrupt change of the correction parameter can be prevented during active time, and consequently the effect of variation in rotational speed of the rotator on image quality can be more reliably suppressed.

BRIEF DESCRIPTION OF THE DRAWINGS

Illustrative aspects in accordance with the preset invention will be described in detail with reference to the following drawings wherein:

FIG. 5 is a table showing a data structure in an NVRAM;

DETAILED DESCRIPTION

An illustrative aspect of the present invention will now be described with reference to FIGS. 1 to 9.

(General Construction of Printer)

Figure 1:
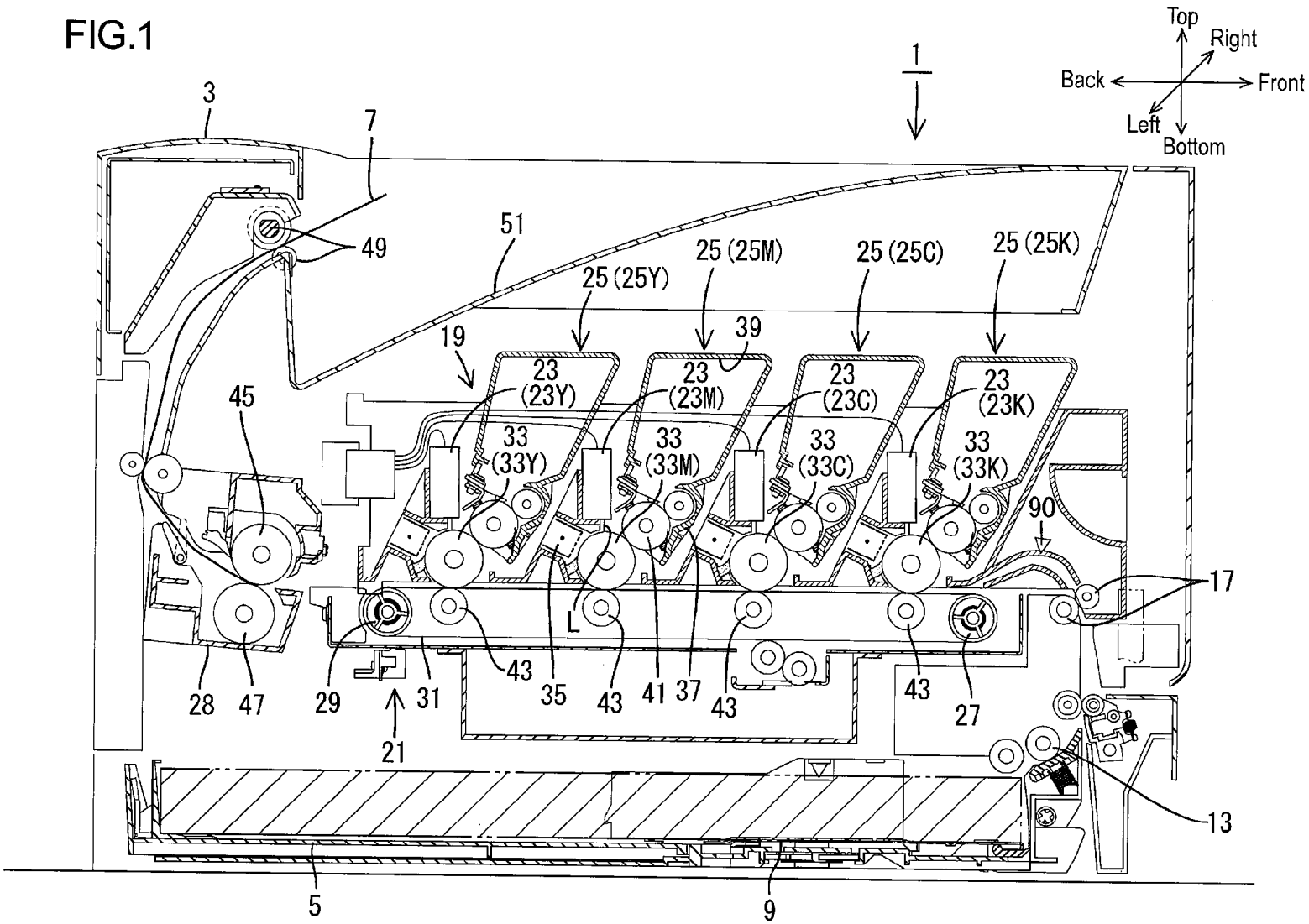
FIG. 1 is a schematic sectional side view of a printer according to an illustrative aspect of the present invention.

FIG. 1 is a schematic sectional side view of an electrophotographic printer 1 according to the present aspect. Hereinafter, the right side of FIG. 1 is referred to as the front side of the printer 1.

Specifically, the printer 1 (i.e., an example of "an image forming apparatus" of the present invention) is a color LED printer of a direct-transfer tandem type, which has a casing 3 as shown in FIG. 1. A feeder tray 5 is provided on the bottom of the casing 3, and recording media 7 (e.g., paper sheets, plastic sheets, and the like) are stacked on the feeder tray 5.

The recording media 7 are pressed against a pickup roller 13 by a platen 9. The pickup roller 13 forwards the top one of the recording media 7 to registration rollers 17, which forward the recording medium 7 to a belt unit 21. If the recording medium 7 is obliquely directed, it is corrected by the registration rollers 17 before forwarded to the belt unit 21.

An image forming section 19 includes the belt unit 21 (as an example of a conveyor means), LED exposure units 23 (as an example of an exposure means), processing units 25, a fixation unit 28 and the like. In the present aspect, at least the LED exposure unit 23 and the processing unit 25 correspond to an example of "an image forming portion" of the present invention.

The belt unit 21 includes a belt 31, which is disposed between a pair of support rollers 27, 29. The belt 31 is driven by rotation of the backside support roller 29, for example. Thereby, the belt 31 rotates in anticlockwise direction in FIG. 1, so as to convey the recording medium 7 (forwarded thereto) backward.

The LED exposure units 23 (i.e., 23K, 23C, 23M and 23Y) are provided for respective colors (i.e., black, cyan, magenta and yellow), each of which includes a plurality of light emitting diodes (not shown) arranged in line along the axial direction of a photoconductor 33. The light emitting diodes of each LED exposure unit 23 are controlled based on image data of the corresponding color so as to switch between ON and OFF. Thereby, light is radiated to the surface of the photoconductor 33 so that an electrostatic latent image is formed on the photoconductor 33.

The processing units 25 (i.e., 25K, 25C, 25M and 25Y) are provided for respective colors (i.e., black, cyan, magenta and yellow). The processing units 25 have the same construction, but differ in color of toner (as an example of a colorant). Hereinafter, the suffixes K (Black), C (Cyan), M (Magenta) and Y (Yellow) for indicating colors are attached to symbols of processing units 25, photoconductors 33 or the like, when necessary. The suffixes are omitted when not necessary.

Each processing unit 25 includes a photoconductor 33 (as an example of "a rotator" or "a carrier"), a charger 35, a developer cartridge 37 and the like. The developer cartridge 37 includes a toner container 39, a developer roller 41 (as an example of a developer image carrier) and the like. The toner container 39 holds toner therein, which is suitably supplied onto the developer roller 41.

The surface of the photoconductor 33 is charged homogeneously and positively by the charger 35, and thereafter is exposed to light L from the LED exposure unit 23 as described above. Thereby, an electrostatic latent image (corresponding to an image of the color to be formed on the recording medium 7) is formed on the surface of the photoconductor 33. The electrostatic latent image is an example of "an image" of the present invention.

Next, the toner on the developer roller 41 is supplied to the surface of the photoconductor 33 so as to adhere to the electrostatic latent image. Thus, the electrostatic latent image of each color is visualized as a toner image of the color on the photoconductor 33.

While the recording medium 7 (being conveyed by the belt 31) passes between each photoconductor 33 and the corresponding transfer roller 43 (as an example of a transfer means), a negative transfer bias is applied to the transfer roller 43. Thereby, the toner images on the respective photoconductors 33 are sequentially transferred to the recording medium 7, which is then forwarded to the fixation unit 28.

Using a heating roller 45 and a pressure roller 47, the fixation unit 28 heats the recording medium 7 that has the resultant toner image, while forwarding it. Thereby, the toner image is thermally fixed to the recording medium 7. After passing through the fixation unit 28, the recording medium 7 is ejected onto a catch tray 51 by discharge rollers 49.

(Drive Mechanism for Photoconductor)

Figure 2:
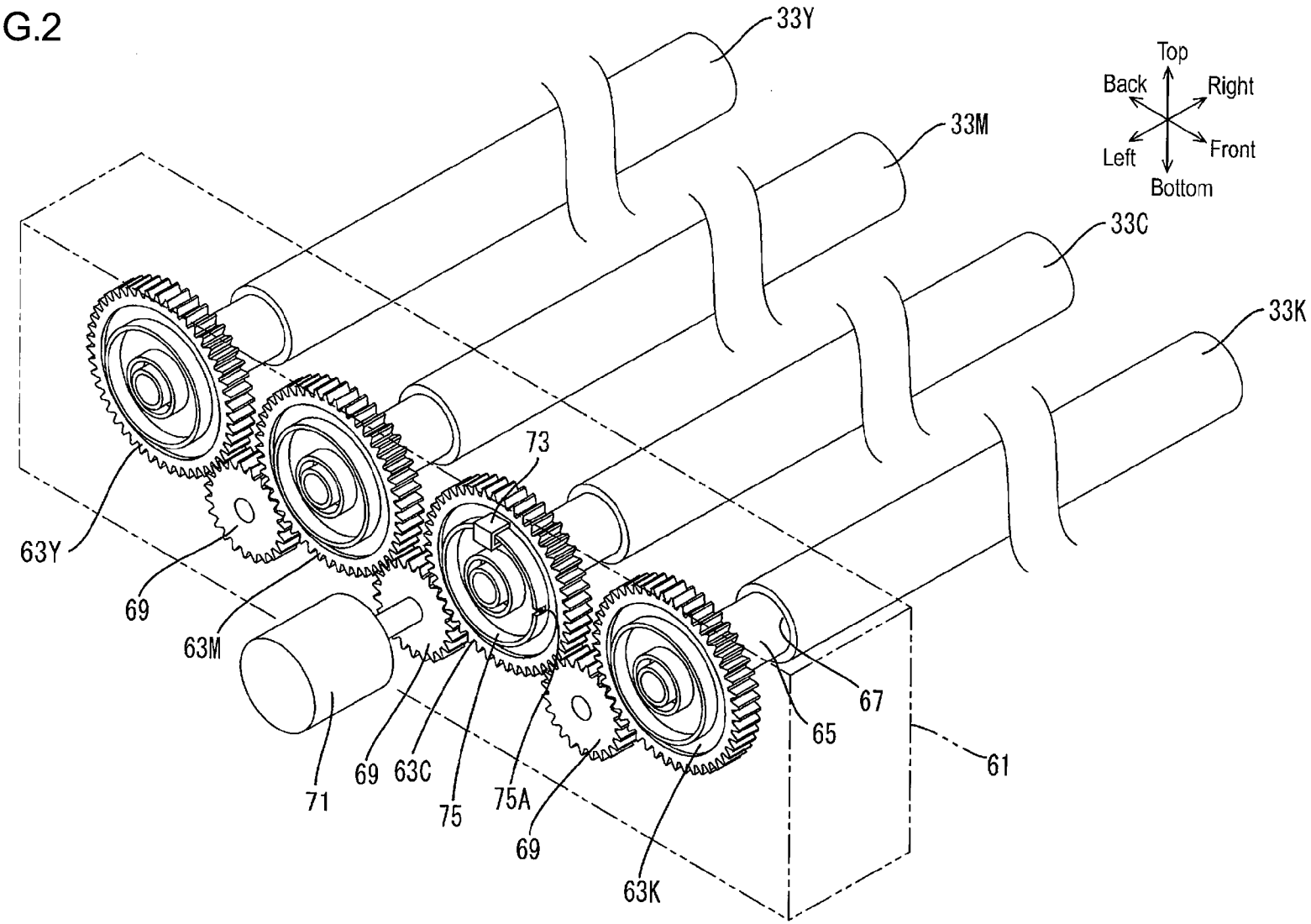
FIG. 2 is a schematic perspective view of the internal structure of a drive unit.

FIG. 2 is a schematic perspective view of the internal structure of a drive unit 61 provided for driving the photoconductors 33 to rotation. The drive unit 61 is disposed on one lateral side of the photoconductors 33, and includes drive gears 63 (i.e., 63K, 63C, 63M and 63Y) provided for respective photoconductors 33 (i.e., 33K, 33C, 33M and 33Y).

Each drive gear 63 is coaxially connected to the corresponding photoconductor 33 by a coupling mechanism. Specifically, an engaging portion 65, coaxially projecting from the drive gear 63, is fitted into a recess 67 formed on the end of the photoconductor 33, so that the drive gear 63 and the photoconductor 33 can rotate in unison when the drive gear 63 is driven to rotation.

The engaging portion 65 is movable between the engaged position shown in FIG. 2 and the detached position. The engaging portion 65 at the detached position is detached from the photoconductor 33. The engaging portion 65 is moved from the engaged position to the detached position, for example, at the time of replacement of the processing unit 25, so that the processing unit 25 can be removed from the casing 3.

Two adjacent drive gears 63 are coupled via an intermediate gear 69. In the present aspect, the middle intermediate gear 69 that connects between the drive gears 63C and 63M can be driven by a motor 71. The four drive gears 63 (and therefore the photoconductors 33 connected thereto) rotate concurrently, when the middle intermediate gear 69 is driven to rotation.

An origin sensor 73 (i.e., an example of "a detecting portion" of the present invention) is disposed on one (e.g., the drive gear 63C in the present aspect) of the drive gears 63. The origin sensor 73 is provided for detecting whether the current phase of the rotating drive gear 63C has reached a predetermined detecting phase point P(0) (or an origin phase point).

In this aspect, the term "Phase" can mean a cyclic motion such as an oscillating motion or a wave motion, and "origin phase point" can mean a point within a cycle which is measured from the origin and expressed as an elapsed time or a rotational angle.

Specifically, a slit 75A is formed on a circular rib portion 75 that is provided on the drive gear 63C and around the rotating shaft thereof. The origin sensor 73 is an optical transmission sensor having a light emitting element and a light receiving element which are arranged on the opposite side of the rib portion 75 from each other.

When the slit 75A is not in the detection area of the origin sensor 73, the level of light received by the light receiving element is relatively low because light from the light emitting element is blocked by the rib portion 75. When the slit 75A is in the detection area (i.e., when the current phase of the drive gear 63C has reached the detecting phase point), the level of light received by the light receiving element is relatively high because light from the light emitting element is not blocked.

The origin sensor 73 outputs a detection signal SA (See FIG. 3) indicating the received light level, in order to inform a CPU 77 (described below) when the origin sensor 73 detects that the current phase of the drive gear 63C has reached the detecting phase point P(0).

The time when the detecting phase point P(0) has been reached should be detected on respective drive gears 63, because a correction process for scanning line interval is executed individually for respective colors (or for respective photoconductors) as described below. Therefore, an origin sensor can be provided separately for each drive gear 63, so that the time when the detecting phase point P(0) has been reached is detected individually for each drive gear 63.

However, the cost of the increased number of origin sensors is high, and accordingly the origin sensor 73 is provided solely on one drive gear 63C in the present aspect. This would cause no problem, because the four drive gears 63 are driven by the common drive motor 71 in the present aspect.

If the drive unit 61 is designed so that the four drive gears 63 simultaneously reach the detecting phase point P(0), it can be detected, directly or indirectly based on the time when one drive gear 63C has reached the detecting phase point P(0), that the four drive gears 63 have reached the detecting phase point P(0).

Each drive gear 63 and the photoconductor 33 connected thereto rotate in unison as described above, and therefore they are considered to be in phase with each other (during rotation). Therefore, the time when the photoconductor 33 has reached the detecting phase point P(0) can be detected indirectly based on the time when the origin sensor 73 detects that the drive gear 63C has reached the detecting phase point P(0).

Hereinafter, "when the drive gear 63 has reached the detecting phase point P(0)" is sometimes used interchangeably with "when the photoconductor 33 has reached the detecting phase point P(0)".

(Electrical Configuration of Printer)

Figure 3:
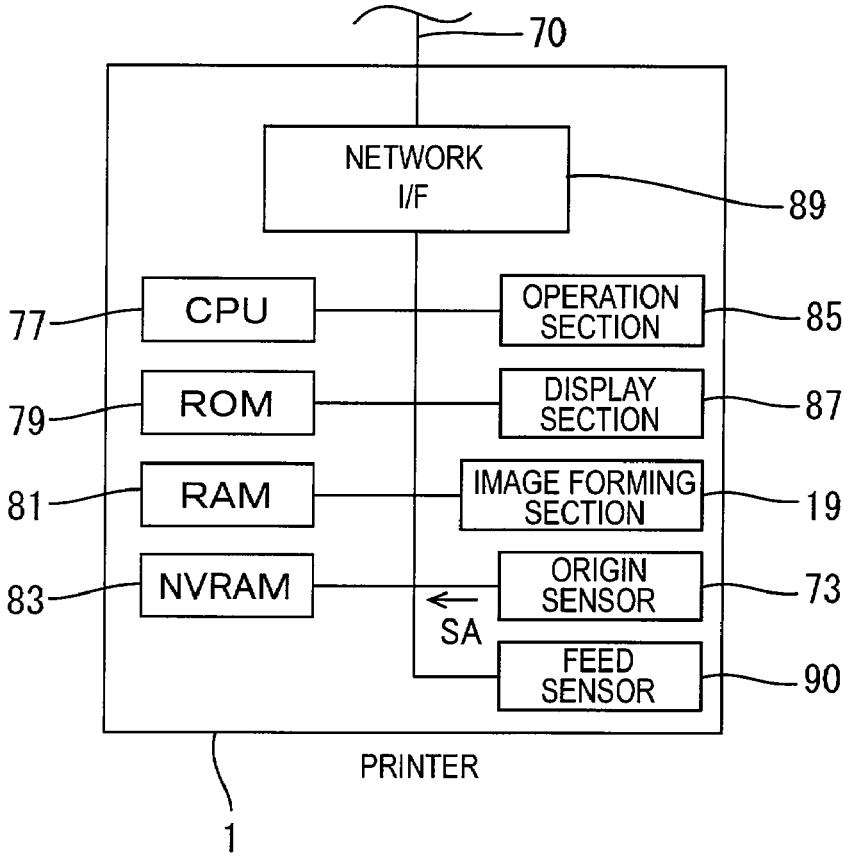
FIG. 3 is a block diagram showing the electrical configuration of the printer.

FIG. 3 is a block diagram showing the electrical configuration of the printer 1. The printer 1 includes a CPU 77, a ROM 79, a RAM 81, an NVRAM 83 (as an example of a storage portion), an operation section 85, a display section 87, the above-described image forming section 19, a network interface 89, the origin sensor 73 and the like.

Various programs for controlling the operation of the printer 1 can be stored in the ROM 79. The CPU 77 controls the operation of the printer 1 based on the programs retrieved from the ROM 79, while storing the processing results in the RAM 81 and/or the NVRAM 83.

The operation section 85 includes a plurality of buttons, which enable a user to perform various input operations, such as an operation for a printing request. The display section 87 can include a liquid-crystal display and indicator lamps. Thereby, various setting screens, the operating condition and the like can be displayed. The network interface 89 can be connected to an external computer (not shown) or the like, via a communication line 70, in order to enable mutual data communication.

(Change Characteristics Information)

Hereinafter, the meanings of terms used in the following explanation will be described.

(a) "Write Time Interval T1" is a time interval between the start of a scanning line and that of the next scanning line when the LED exposure unit 23 scans the photoconductor 33.

(b) "Scanning Line Interval" is a distance in the circumferential direction (secondary scanning direction) of the photoconductor 33 between a scanning line and the next scanning line, measured in an electrostatic latent image on the photoconductor 33 (or a distance in the secondary scanning direction between a scanning line and the next scanning line, measured in an image transferred to a recording medium 7).

Note that the starting position of each scanning line on the photoconductor 33 (or the corresponding position on the recording medium 7) is an example of "an image forming position".

(c) "Regulation Speed" is a rotational speed of the photoconductor 33 or the drive gear 63, prescribed according to the design. The regulation speed can be changed depending on printing conditions such as a print speed, print resolution, or material or quality of a recording medium.

(d) "Regulation Line Interval" is a proper scanning line interval determined based on printing conditions such as a print resolution. Conversely, an image can be formed while satisfying the above printing conditions, if the scanning line interval is consistently adjusted to the regulation line interval.

(e) "Detecting-point Time Interval" is a write time interval at the detecting phase point P(0). In the present aspect, for ease of explanation, it is assumed that the detecting-point time interval is equal to "a regulation time interval" that is a write time interval DS, at which line scanning is performed so that the scanning line interval is adjusted to the regulation line interval when the rotational speed of the drive gear 63 is equal to the regulation speed.

However, the detecting-point time interval may not be equal to the regulation time interval. In this case, the detecting-point time interval should be corrected using a correction amount (i.e., a correction amount corresponding to the detecting phase point P(0) described below) so as to be equal to the regulation time interval.

(f) "Correction Amount D(N)" is a correction amount of time used for correcting the scanning line interval at each phase point P(N) into the regulation line interval, where N is an integer from 0 to M.

The write time interval T1(N) at each phase point P(N) is determined by correcting the regulation time interval (i.e., detecting-point time interval DS in the present aspect) using the correction amount D(N). That is, the write time interval T1(N) can be expressed by the following formula:

$$T1(N)=DS+D(N)$$

where D(0) is equal to zero in the present aspect, as described in the above (e).

Note that the write time interval T1(N) indicates a time required for the photoconductor 33 at the phase point P(N) to rotate to the next phase point P(N+1) (or a time required for the photoconductor 33 at the phase point P(M) to rotate to the next phase point P(0) when N=M).

The correction amount D(N) for each phase point P(N) is determined based on the measured value of the rotational speed of the photoconductor 33 at the phase point P(N), as described below. The correction amount D(N) is an example of "a correction parameter".

(g) "Correction Difference ΔD(N)" is the relative difference between the correction amount D(N) and the correction amount D(N−1) (or the relative difference between D(0) and D(M) when N=0). That is, the correction difference ΔD(N) can be expressed by the following formula:

$$\Delta D(0)=D(0)-D(M);$$

$$\Delta D(N)=D(N)-D(N-1) \text{ for } N=1, \ldots, M.$$

In the present aspect, the correction difference ΔD(N) corresponding to each phase point P(N) is stored in the NVRAM 83, and is used for correcting the write time interval T1 during a correction process for the scanning line interval, as described below.

During the correction process, the write time interval T1(N) at a phase point P(N) is determined by correcting the write time interval T1(N−1) (or T1(M) when N=0) at the previous phase point P(N−1) (or P(M) when N=0) using the correction difference ΔD(N), as follows:

$$T1(0)=DS+D(0) \text{ for the first } P(N), \text{ where } D(0)=0 \text{ in the present aspect;}$$

$$T1(N)=T1(N-1)+\Delta D(N) \text{ for } N=1, \ldots, M;$$

$$T1(0)=T1(M)+\Delta D(0) \text{ for the second or later } P(N).$$

That is, the resultant correction amount D(N) for each phase point P(N) can be expressed, using the correction differences ΔD(0) to ΔD(N), by the following formula:

$$D(N)=\Delta D(1)+\ldots+\Delta D(N) \text{ for } N=1, \ldots, M;$$

$$D(0)=\Delta D(1)+\ldots+\Delta D(M)+\Delta D(0)=0 \text{ for the second or later } P(N).$$

Note that ΔD(0)=−(ΔD(1)+ . . . +ΔD(M)) because of the above definition of the correction difference ΔD(0). Therefore, the correction amount D(0) for the detecting phase point P(0) is consistently zero, in the present aspect.

The scanning line interval may vary (i.e., fail to be consistently adjusted to the regulation line interval) due to variation in rotational speed of the photoconductor 33. Therefore, the scanning line interval is corrected into the regulation line interval, using change characteristics information shown in FIG. 5.

FIG. 5 shows change characteristics information provided for one color or one photoconductor 33. In the present aspect, the change characteristics information is provided individually for respective colors, and is stored in the NVRAM 83. That is, four units of change characteristics information are stored in the NVRAM 83.

Figure 4:
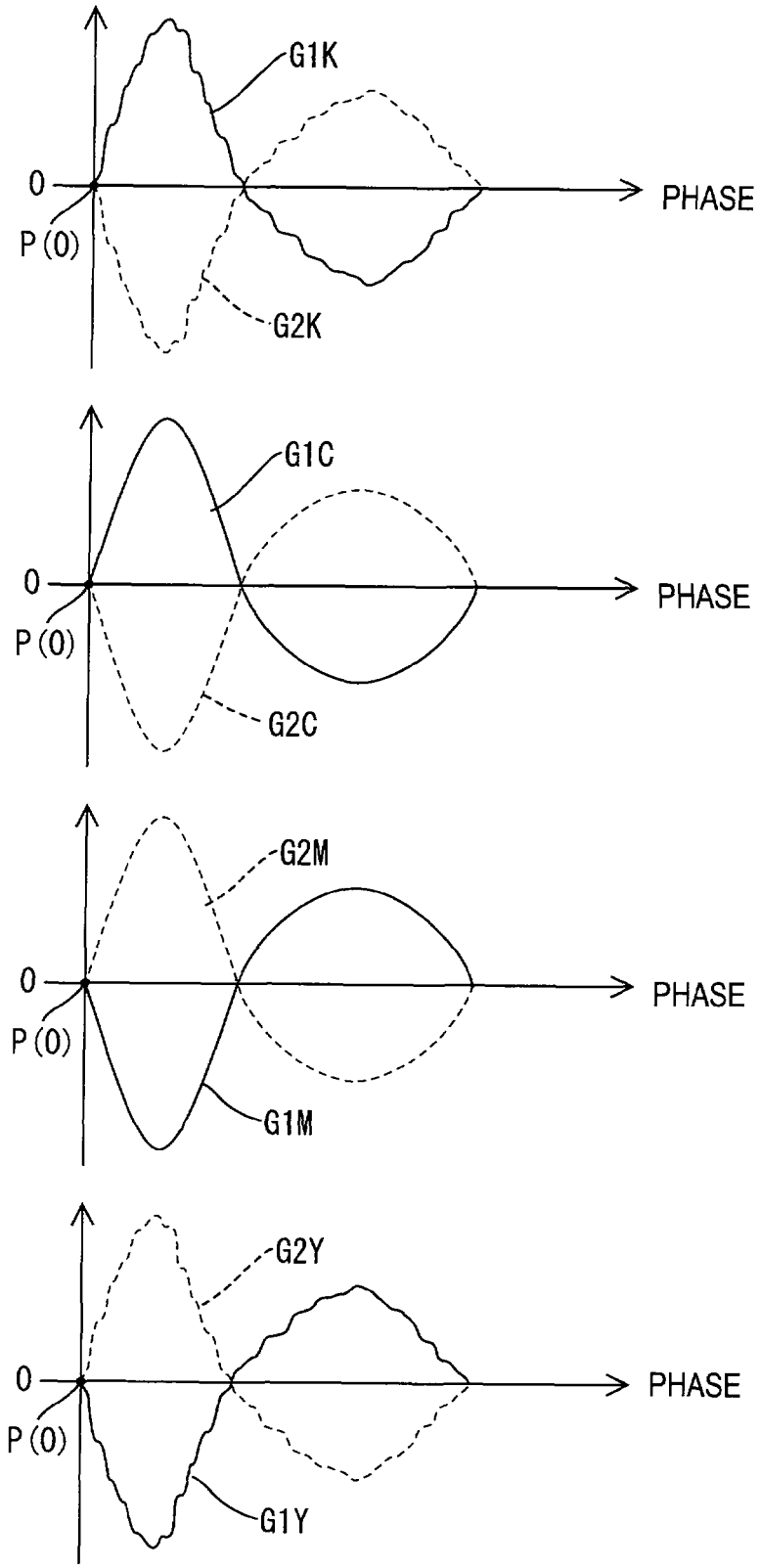
FIG. 4 is a graph showing variation in rotational speed of each drive gear and variation in correction amount.

Hereinafter, the change characteristics information will be explained in detail. FIG. 4 shows the variation in rotational speed of each drive gear 63 during one cycle. The four graphs in FIG. 4 correspond to the respective drive gears 63.

The solid line G1 (i.e., G1K, G1C, G1M or G1Y) in each graph is generated using measured values of the rotational speed of the drive gear 63 (i.e., 63K, 63C, 63M or 63Y). More specifically, the solid line G1 is generated by plotting a value corresponding to the difference between each measured value and the regulation speed.

If the value on the solid line G1 corresponding to a phase point is larger than zero, the actual rotational speed of the drive gear 63 at the phase point is higher than the regulation speed. Therefore, if the write time interval T1 at the phase point is set to the regulation time interval, the resultant scanning line interval could be longer than the regulation line interval.

In contrast, if the value on the solid line G1 corresponding to a phase point is smaller than zero, the actual rotational speed of the drive gear 63 at the phase point is lower than the regulation speed. Therefore, if the write time interval T1 at the phase point is set to the regulation time interval, the resultant scanning line interval could be shorter than the regulation line interval.

The dotted line G2 (i.e., G2K, G2C, G2M or G2Y) in each graph represents the variation of the correction amount D(N). More specifically, the above-described correction amount D(N) corresponding to each phase point P(N) is shown as a point on the dotted line G2.

The dotted line G2 is symmetrical to the solid line G1 with respect to Zero line (or Phase axis). That is, if the value on the solid line G1 corresponding to a phase point P(N) is larger than zero (i.e., if the rotational speed of the photoconductor 33 at the phase point P(N) is higher than the regulation speed), the write time interval T1(N) at the phase point P(N) is corrected using a correction amount D(N) having a negative value.

Conversely, if the value on the solid line G1 corresponding to a phase point P(N) is smaller than zero (i.e., if the rotational speed of the photoconductor 33 at the phase point P(N) is lower than the regulation speed), the write time interval T1(N) at the phase point P(N) is corrected using a correction amount D(N) having a positive value. Thereby, the resultant scanning line interval can be consistently adjusted to the regulation line interval.

The above-described correction difference ΔD(N) corresponding to each phase point P(N) is derived from the correction amounts D(N) (shown as the dotted line G2 in FIG. 4). The derived correction differences ΔD(N) (i.e., ΔD(0) to ΔD(M)) are stored as the change characteristics information in the NVRAM 83.

More specifically, the correction differences ΔD(N) are derived for each drive gear 63 as described above, and are stored as a table showing a correspondence relation between Addresses (N) and the correction differences AD(N) where N is an integer from 0 to M, as shown in FIG. 5. The Addresses (N) correspond to the phase point numbers of respective phase points P(N).

(Correction Process for Scanning Line Interval)

Figure 6:
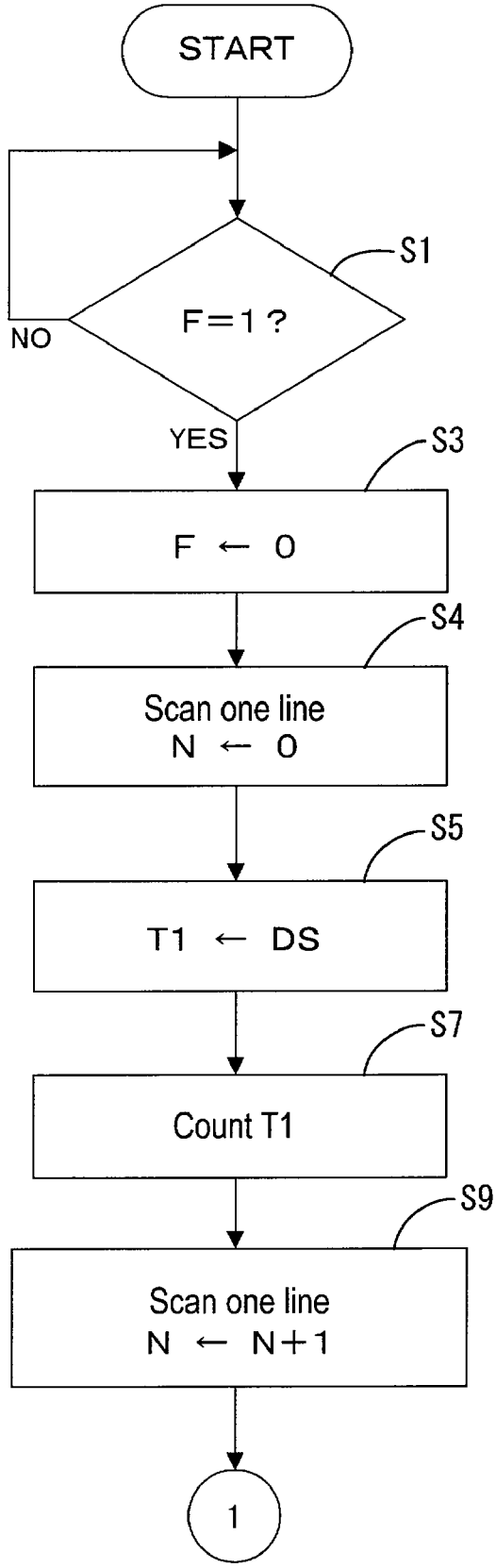
FIG. 6 is a flowchart of the first half of a correction process according to the illustrative aspect.
Figure 7:
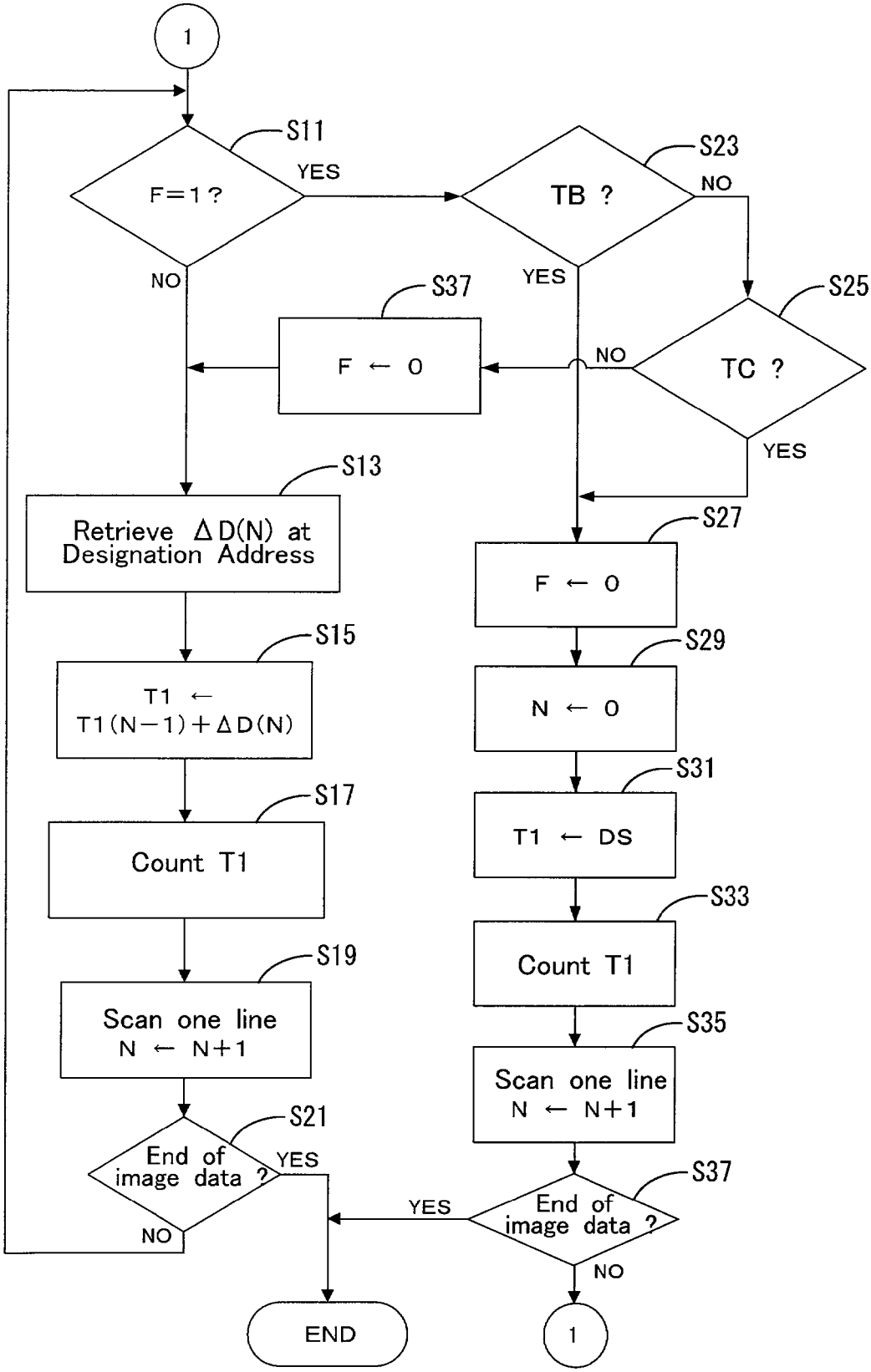
FIG. 7 is a flowchart of the second half of the correction process.

FIGS. 6 and 7 show a correction process for the scanning line interval. In the present aspect, the correction process will not be executed during monochrome printing performed using a single processing unit 25 (e.g., processing unit 25K for black).

That is, the correction process is executed during color printing performed using two or more of processing units 25. This is because the effect of variation in scanning line interval due to variation in rotational speed of the photoconductor 33 can appear as a color shift prominently in a color image formed by superimposing images of respective colors.

In the present aspect, the correction process is executed individually for respective colors, using the change characteristics information provided individually for respective colors. The following explanation points to the correction process executed for a cyan image, as an example. The correction process can be executed for the other colors in a similar manner.

If the CPU 77 receives image data, for example, from an external computer via the network interface 89, or receives a printing request from a user via the operation section 85, it starts a printing process by causing rotation of the photoconductors 33, belt 31 and the like. Then, the recording media 7 from the feeder tray 5 are forwarded to the registration rollers 17 one by one.

In the present aspect, a feed sensor 90 is provided in the vicinity of the registration rollers 17 as shown in FIG. 1, so as to detect the recording medium 7 forwarded from the registration rollers 17 to the belt unit 21.

Figure 8:
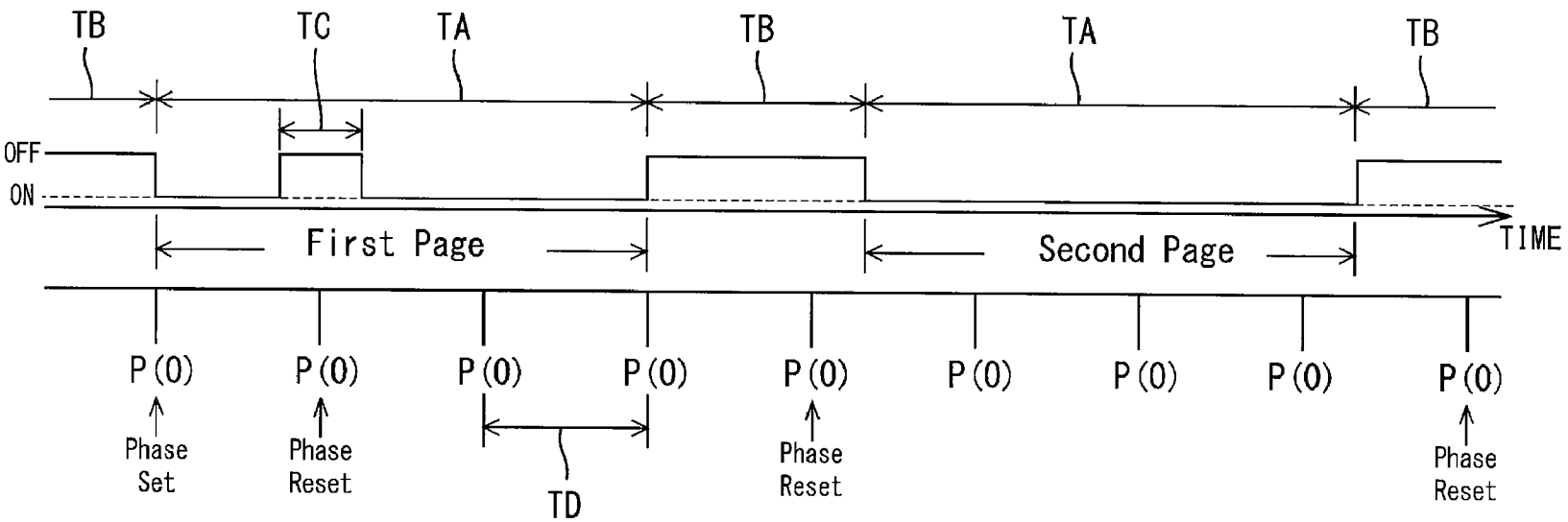
FIG. 8 is a timing chart showing times when phase estimation is reset.

Referring to FIG. 8, the CPU 77 outputs an ON signal to the LED exposure unit 23C for indicating the starting time of image formation, based on the time when the feed sensor 90 has detected the leading edge of the recording medium 7. In response to the ON signal, the LED exposure unit 23C starts to form an electrostatic latent image (associated with one sheet of recording media 7) on the photoconductor 33C by line scanning.

Thereafter, the CPU 77 outputs an OFF signal to the LED exposure unit 23C for indicating the ending time of image formation, based on the time when the feed sensor 90 has detected the rear edge of the recording medium 7. In response to the OFF signal, the LED exposure unit 23C terminates the formation of the electrostatic latent image.

Hereinafter, the time until the above ending time after the starting time is referred to as "imaging time TA", while the rest of time is referred to as "non-imaging time TB". That is, the non-imaging time TB includes the time before the starting time and the time after the ending time.

If the image data associated with a printing request includes a plurality of pages of data, electrostatic latent images associated with the respective pages are sequentially formed on the photoconductor 33C as shown in FIG. 8, while the recording media 7 from the feeder tray 5 are sequentially forwarded to the belt unit 21 at intervals. In this case, the time until the starting time of a page after the ending time of the previous page is also included in the non-imaging time TB.

The CPU 77 executes the correction process shown in FIGS. 6 and 7, during the printing process. Thereby, the scanning line interval in the resultant electrostatic latent image on the photoconductor 33C is consistently adjusted to the regulation line interval, based on the change characteristics information.

Referring to FIG. 6, the CPU 77 determines at step S1 whether a detection flag F is set to 1 (F=1) or not. The detection flag F is initially set to 0, and thereafter is set to 1 in response to the detection signal SA, which is outputted from the origin sensor 73 for indicating that the current phase of the photoconductor 33C has reached the detecting phase point P(0).

If it is determined that the detection flag F is set to 1 (i.e., "YES" is determined at step S1), the process proceeds to step S3. Thus, the CPU 77 starts the correction process, when the detecting phase point (or origin phase point) P(0) is detected by the origin sensor 73.

At step S3, the detection flag F is cleared or set to zero (F=0). Next, the CPU 77 instructs the LED exposure unit 23C to scan one line at step S4, so that scan of the first line is performed. Further, the address pointer for indicating one of Addresses (0) to (M) is initialized at step S4. That is, the address indicated by the address pointer (hereinafter, referred to as "Designation Address (N)") is set to Address(0).

During the following steps, the CPU 77 sequentially estimates the times when the phase points P(N) (i.e., P(1) to P(M)) are reached, using the change characteristics information and an internal clock. The CPU 77 instructs the LED exposure unit 23C to scan one line (along the main scanning direction) beginning at each estimated time (or estimated phase point P(N)). Thus, the line scanning proceeds one line after another.

If the estimated phase point has reached the final phase point P(M), the time when the origin phase point P(0) is reached for the second time is next estimated, and thereby another cycle is started. Thus, cycles are repeated until the end of image data.

In the present aspect, the estimated phase point P(N) can be reset or corrected during the non-imaging time TB (or during blank imaging time TC described below), based on the detecting phase point P(0) detected by the origin sensor 73.

(1) Process Before Reset of Estimated Phase Point

Returning to FIG. 6, the detecting-point time interval DS is assigned to the write time interval T1 at step S5, after the scan of the first line at step S4. The value of the detecting-point time interval DS is preliminarily stored in the NVRAM 83.

At step S7, the CPU 77 counts or measures the write time interval T1 (which is currently set to the detecting-point time interval DS), using the internal clock. Thus, the CPU 77 can count a time using the internal clock, and thereby function as "a timer portion".

When the count of the write time interval T1 is completed, the CPU 77 instructs the LED exposure unit 23C to scan one line at step S9. Further, the address pointer is incremented at step S9. That is, the Designation Address (N), which is initially set to Address(0) at step S4, is next set to Address(1).

Next, referring to FIG. 7, it is determined again at step S11 whether the detection flag F is set to 1 or not. "NO" is determined at step S11 because the detection flag F has been cleared at step S3, and therefore the process proceeds to step S13. The CPU 77 executing step S11 functions "a first determining portion" of the present invention.

At step S13, the correction difference ΔD(N) is retrieved from the current Designation Address (N). At step S15, the retrieved correction difference ΔD(N) is added to the current write time interval T1(N−1), so that the resultant is newly assigned to the write time interval T1.

Specifically, the CPU 77 retrieves the correction difference ΔD(1) from the change characteristics information, when the Designation Address (N) is set to Address(1), for example. Then, the retrieved correction difference ΔD(1) is added to the current write interval T1(0) (which is set to DS), and thereby the write time interval T1 is newly set to (DS+ΔD(1)).

Thus, the write time interval T1 is corrected using the change characteristics information in the NVRAM 83. The CPU 77 executing steps S13 and S15 functions as "a designating portion" of the present invention.

At step S17, the CPU 77 counts the corrected write time interval T1(N) using the internal clock. When the count is completed, the CPU 77 instructs the LED exposure unit 23C to scan one line at step S19. The CPU 77 executing steps S17 and S19 functions as "a correcting portion" of the present invention.

Further, the Designation Address (N) is set to the next Address (N+1), except when the current Designation Address is Address (M). When the current Designation Address is Address (M), referring to FIG. 5, the Designation Address (N) is reset or returned to Address(0) at step S19.

At step S21, it is determined whether the end of the image data has been reached. If "NO" is determined at step S21, the process returns to step S11. If scanning based on the image data associated with the present print job is completed (i.e., "YES" is determined at step S21), the present correction process terminates.

(2) Proposed Technique and Problem Therewith

In the present aspect, the origin sensor 73 can directly detects when the current phase of (rotation of) the photoconductor 33C has reached the detecting phase point P(0).

However, as for the other phase points P(1) to P(M), the time when the phase point has been reached cannot be detected directly, and therefore that is estimated by the CPU 77 based on the base time point and the time counted by the internal clock.

The base time point means a reference time point used for estimating the time when each phase point is reached. The base time point is initially set to an actual time point corresponding to the detecting phase point P(0), in the present aspect.

As described above, the CPU 77 estimates the time when the phase point P(1) is reached, by counting the detecting-point time interval DS (i.e., the write time interval T(0)) since the base time point (corresponding to the detecting point phase P(0)) using the internal clock. When the estimated phase point P(1) has been reached, the CPU 77 (as the designating portion) designates the correction difference ΔD(1) corresponding to Address(1).

The write time interval T1 is corrected using the correction difference ΔD(1). That is, the next write time interval T1(1) is determined as (T1(0)+ΔD(1)) (e.g., (DS+ΔD(1)) in the present aspect).

The CPU 77 estimates the time when the next phase point P(2) is reached, by counting the write time interval T(1) using the internal clock. Thus, the phase points P(N) are sequentially estimated based on the base time point and the time counted by the internal clock.

If the internal clock can count time accurately, the phase points sequentially estimated based on the internal clock will coincide with the actual phase points P(1) to P(M).

Therefore, in this case, the correction differences ΔD(N) in the change characteristics information are appropriately designated at the respective actual phase points P(N), and thereby the scanning line interval can be consistently adjusted to the regulation line interval during line scanning.

However, the internal clock fails to count time accurately in some cases, for example, due to a malfunctioning oscillator that can be used therein for generating clock signals, or due to variation in pulse interval caused by variation in internal temperature of the printer 1.

In this case, the estimated phase points based on the internal clock may have an error, that is, differ from the actual phase points. The error will be accumulated as the photoconductor 33C rotates, i.e., in a succession of estimation.

Consequently, the correction differences ΔD(N) in the change characteristics information may be inappropriately designated based on the inaccurately estimated phase points P(N), and thereby the scanning line interval could fail to be consistently adjusted to the regulation line interval during line scanning.

Therefore, the estimated phase point should be reset or corrected at an appropriate time during the printing process, so as to coincide with the actual phase point.

In the present aspect, the detecting phase point P(0) can be solely detected based on the actual rotation of the photoconductor 33C, and accordingly can be used for the reset or correction of the estimated phase point.

As a technique therefor, it is proposed that the estimated phase point is corrected right when the detecting phase point P(0) has been detected.

That is, the estimated phase point may be reset or forcibly shifted to the detecting phase point P(0) when the detecting phase point P(0) has been detected, because the phase of the photoconductor 33C actually reaches the detecting phase point P(0) at the time. If the estimated phase point is thus corrected at every detecting phase point P(0), inadequacy of the scanning line interval correction due to error in phase estimation can be mitigated slightly.

However, the following problem arises in this case. If the correction amount D(N) or D(0) varies steeply around the detecting phase point P(0), the correction amount actually used at the detecting phase point P(0) differs further greatly from the correction amount used at the previous phase point due to the above shift of the estimated phase point. This results in abrupt change in scanning line interval, which could adversely affect the image quality.

Figure 9:
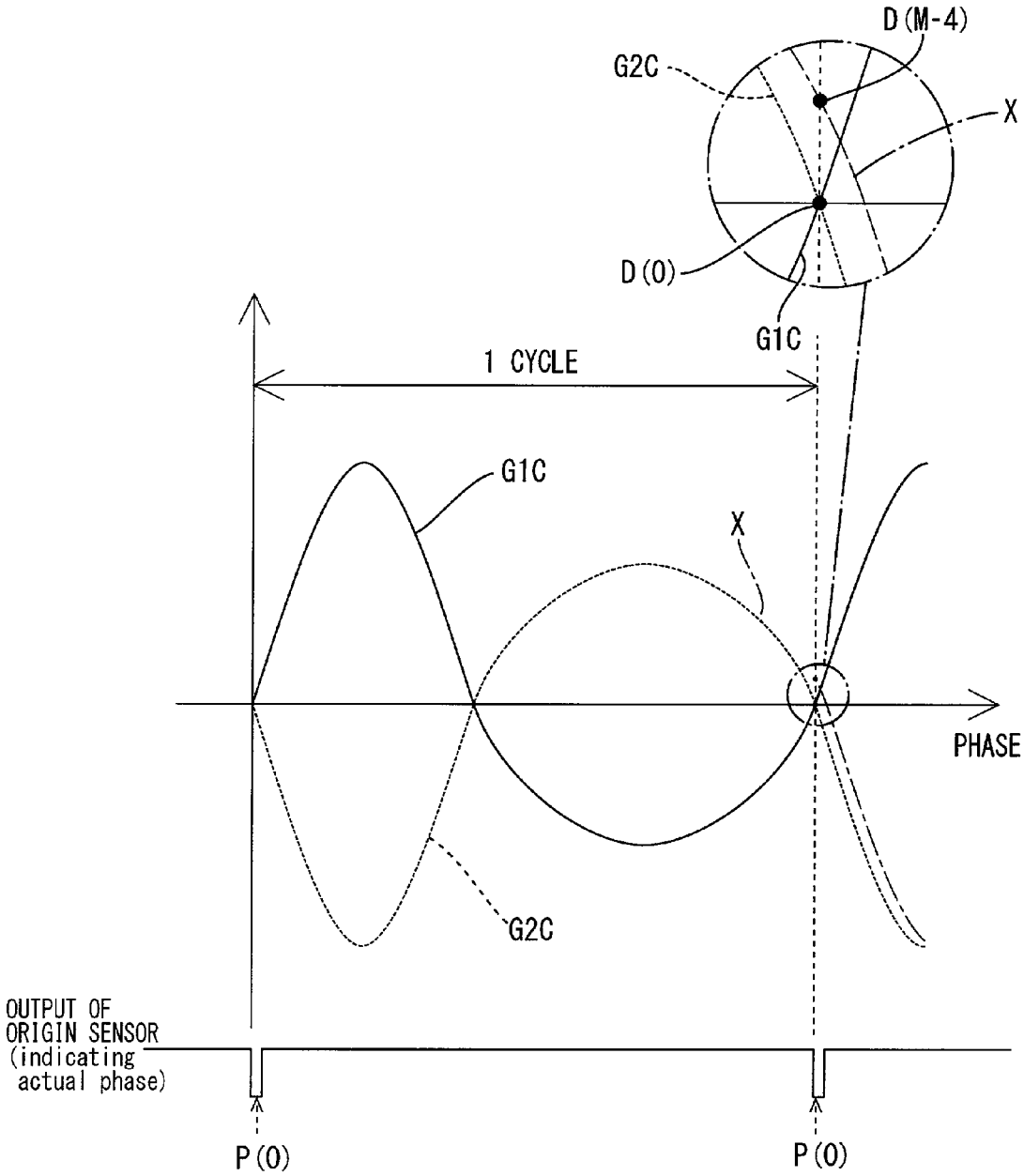
FIG. 9 is a graph for explanation of a shift amount of the correction amount due to shift of an estimated phase point.

Specifically, in the case that the estimated phase point is, for example, prone to lag behind the actual phase, the correction amount D(N) designated based on the estimated phase point changes with respect to the actual phase as shown by a chain line X in FIG. 9. In this case, the actual phase will reach the detecting phase point P(0), before the estimated phase point reaches the detecting phase point P(0) (e.g., when the estimated phase point indicates P(M−4)).

If the correction amount D(M−4) based on the estimated phase point P(M−4) is shifted to the correction amount D(0) at the detecting phase point P(0) (i.e., the write time interval T1 is reset to the detecting point time interval DS, in the present aspect) as described above, the shift amount (i.e., the difference between the correction amounts D(M−4) and D(0)) could be large, because the correction amount D(N) or D(0) changes steeply around the detecting phase point P(0).

That is, the correction amount D(0) actually used at the detecting phase point P(0) differs greatly from the correction amount D(M−5) used at the previous phase point. Thus, the scanning line interval may be abruptly changed at the detecting phase point P(0), which could adversely affect the image quality, for example, resulting in distortion of an electrostatic latent image formed on the photoconductor 33C.

(3) Process for Reset of Estimated Phase Point

In view of the above, the reset or correction of the estimated phase point, based on the detecting phase point P(0) detected by the origin sensor 73, is executed during non-imaging time TB described above, in the present aspect.

Image formation is suspended during non-imaging time TB. Therefore, the image quality will not be degraded, even if the scanning line interval is abruptly changed during non-imaging time TB. The non-imaging time TB is an example of "inactive time".

Further, an image to be formed on a recording medium 7 may include a blank image portion that corresponds to an area of an electrostatic latent image for each color that has not been irradiated. In this case, imaging time TA (described above) includes blank imaging time TC, as shown in FIG. 8.

During the blank imaging time TC, radiation by the LED exposure unit 23C is suspended, and therefore the image quality will not be degraded even if the scanning line interval is abruptly changed. For this reason, in the present aspect, the reset or correction of the estimated phase point is executed during blank imaging time TC as well as non-imaging time TB.

That is, reset or correction of the estimated phase point is skipped during imaging time TA except for blank imaging time TC, even if the detecting phase point P(0) is detected by the origin sensor 73. The blank imaging time TC as well as the non-imaging time TB is an example of "inactive time".

In the present aspect, referring to FIG. 8, the non-imaging time TB between pages is set to be longer than the detecting time interval TD (i.e., the measured time interval between the detecting phase points P(0)).

Thereby, the detecting phase point P(0) can be detected by the origin sensor 73 at least once during every non-imaging time TB between pages, and therefore resetting or correction of the estimated phase point can be executed at least once during every non-imaging time TB between pages.

This construction can be achieved by adjusting the timing for forwarding a recording medium 7 so that the length of each non-imaging time TB between pages can be longer than the detecting time interval TD. Alternatively, the construction can be achieved, for example, by appropriately setting the diameter or rotational speed of the photoconductor 33C, or by increasing sensors so that two or more detecting phase points can be detected during each cycle.

When the photoconductor 33C has completed one revolution, returning to FIG. 7, "YES" is determined at step S11 because the detection flag F is set to 1 in response to detection of the detecting phase point P(0). Then, the process proceeds to step S23.

At step S23, it is determined, based on the ON/OFF signal from the feed sensor 90, whether the present process is in the middle of non-imaging time TB. If it is determined that the present process is not in the middle of non-imaging time TB (i.e., "NO" is determined at step S23), the process proceeds step S25.

Next, it is determined at step S25 whether the present process is in the middle of blank imaging time TC. This determination can be made as follows.

The CPU 77 processes at least one line of image data at a time, and thereby develops the image data of each color into dot data, line by line. At that time, the CPU 77 determines whether each line corresponds to a blank line. The blank line is a line to be formed on the recording medium 7 by superimposing blank lines of respective colors, and therefore does not include an image portion corresponding to an irradiated area of an electrostatic latent image.

The dot data for each color is temporarily stored, for example, in a buffer area of the RAM 81. When the starting time for one line scanning has been reached (e.g., at step S19 of FIG. 7), one-line dot data for cyan is forwarded to the LED exposure unit 23C.

In this construction, at step S25, the CPU 77 can determine whether the present process is in the middle of blank imaging time TC, based on whether the next scanning line (i.e., a scanning line to be started when step S19 or S33 described below is next executed) corresponds to a blank line. The CPU 77 executing steps S23 and S25 functions as "a second determining portion" of the present invention.

If it is determined that the present process is in the middle of neither non-imaging time TB nor blank imaging time TC (i.e., "NO" is determined at both of steps S23 and S25), the process proceeds to step S37 where the detection flag F is cleared. Then the process proceeds to step S13, and thereby steps S13 to S21 are executed in a manner described above.

That is, the correction difference ΔD(N) is retrieved from the change characteristics information, based on the estimated phase point P(N) without being corrected. The write time interval T1 is corrected using the retrieved correction difference ΔD(N), and one line scanning is started when count of the corrected write time interval T1 is completed.

Thus, reset or correction of the estimated phase point is skipped during nonblank imaging time, so that degradation of image quality due to reset of estimated phase point can be prevented.

If it is determined that the present process is in the middle of non-imaging time TB or blank imaging time TC (i.e., "YES" is determined at step S23 or S25), the process proceeds to step S27 where the detection flag F is cleared.

Assuming that the estimated phase point currently indicates the phase point P(M−4), the Designation Address indicated by the address pointer is forcibly shifted from Address (M−4) to Address (0) at step S29.

At step S31, the write time interval T1(0) corresponding to the detecting phase point P(0), which is equal to DS and is preliminarily stored in the NVRAM 83, is newly assigned to the write time interval T1. Thus, the write time interval T1 is corrected to be equal to the detecting-point time interval DS. That is, the correction amount D(N) is shifted from D(M−4) to D(0).

At step S33, the CPU 77 counts the corrected write time interval T1 using the internal clock. When the count is completed, the CPU 77 instructs the LED exposure unit 23C to scan one line at step S35. Further, the Designation Address is set to the next Address (N+1) (i.e., Address(1)). At step S37, it is determined whether the end of the image data has been reached. If "NO" is determined at step S37, the process returns to step S11. If scanning based on the image data associated with the present print job is completed (i.e., "YES" is determined at step S37), the present correction process terminates. At step S33, the CPU 77 counts the corrected write time interval T1 using the internal clock. When the count is completed, the CPU 77 instructs the LED exposure unit 23C to scan one line at step S35. Further, the Designation Address is set to the next Address (N+1) (i.e., Address(1)). At step S37, it is determined whether the end of the image data has been reached. If "NO" is determined at step S37, the process returns to step S11. If scanning based on the image data associated with the present print job is completed (i.e., "YES" is determined at step S37), the present correction process terminates.

Thus, during the above steps S29 to S33, the estimated phase point is corrected or reset to the detecting phase point P(0). That is, the estimated phase point is shifted to the detecting phase point P(0) and thereby the correction amount is shifted to D(0), when an actual time point (hereinafter, referred to as "an initialization time point") corresponding to the detecting phase point P(0) has been reached.

Further, the base time point is reset to the initialization time point (i.e., the actual time point corresponding to the detecting phase point P(0)), so that subsequent estimated phase points can be determined based on a more accurate base time point and count using the internal clock.

The detecting phase point P(0) is an example of "a shifting phase point", and the CPU 77 executing steps S29 to S33 functions as "a shifting portion" of the present invention.

Thereafter, the estimated phase point is corrected or reset to the detecting phase point P(0), whenever the detecting phase point P(0) has been detected (i.e., whenever an initialization time point has been reached) during non-imaging time TB or blank imaging time TC, as shown in FIG. 8. At the time, the base time point is also reset to the initialization time point, so that subsequent estimated phase points can be determined based on a more accurate base time point and count using the internal clock.

Note that a blank line does not mean a blank line for cyan, but a blank line for all colors, as described above. Therefore, shift of the estimated phase point at the same blank line could be executed for all colors. That is, the position of the phase shift on the resultant color image is the same for all colors, and further it is on the blank line. Accordingly, a color shift in the resultant color image due to the phase shift can be prevented.

If the end of the image data associated with the present print job has been reached when step S35 is completed, the present correction process terminates without returning to step S11.

The explanation was made on the correction process executed for a cyan image. In the present aspect, the CPU 77 executes the correction process individually for respective colors or respective photoconductors 33 as described above, and the correction process can be executed for other colors in a similar manner.

(Effect of the Present Aspect)

(1) According to the present aspect, during a printing process, the current phase of the photoconductor 33 is estimated based on the base time point, and the correction amount D(N) corresponding to the estimated phase point P(N) is designated based on the change characteristics information. The start time of the current scanning line is corrected using the designated correction amount D(N).

The base time point is initially set to an actual time point corresponding to the detecting phase point P(0). When an initialization time point corresponding to the detecting phase point P(0) is thereafter reached during non-imaging time TB or blank imaging time TC, the base time point is reset to the initialization time point. At the time, the estimated phase point is shifted to the detecting phase point P(0), and thereby the correction amount is shifted to D(0).

The initialization time point can be determined based on detection of an actual time point corresponding to the detecting phase point P(0). Therefore, the estimated phase point can be corrected to be more approximate to the actual phase point of the photoconductor 33 by the above reset of the base time point and the shift of the estimated phase point.

Thus, the accumulated error in the estimated phase point is cleared when an initialization time point corresponding to the detecting phase point P(0) is reached during non-imaging time TB or blank imaging time TC.

Thereby, inadequacy of the scanning line interval correction due to error in phase estimation can be mitigated, and consequently the effect of variation in rotational speed of the photoconductor 33 on image quality can be suppressed adequately.

Further, in the present aspect, reset or correction of the estimated phase point is skipped during imaging time TA except for blank imaging time TC. That is, shift of the correction amount D(N) or D(0) is skipped during nonblank imaging time, even when the detecting phase point P(0) has been reached.

Thus, shift of the correction amount D(N) may be executed only during inactive time (i.e., during non-imaging time TB or blank imaging time TC). Thereby, abrupt change of the scanning line interval can be prevented during active time (i.e., during nonblank imaging time), and consequently the effect of variation in rotational speed of the photoconductor 33 on image quality can be more reliably suppressed.

(2) According to the present aspect, the shifting phase point is set to the detecting phase point P(0). That is, correction of the estimated phase point and reset of the base time point can be performed at the time of detection of the detecting phase point (i.e., right when the origin sensor 73 has detected the detecting phase point P(0)).

Thereby, the estimated phase point can be more accurately corrected, compared to a construction in which the shifting phase point is set to a phase point other than the detecting phase point P(0). Thus, according to the present aspect, the error in the estimated phase point, i.e., the difference between the estimated phase point (that is determined based on the base time point) and the actual phase point, can be effectively minimized.

(3) In the present aspect, whether the process is in the middle of inactive time (during which reset of the estimated phase point is allowed) is determined based on whether the process is in the middle of non-imaging time TB. This is because the determination can be made relatively readily, for example, based on the receipt time of a printing request and/or the traveling speed of a recording medium 7.

Further, in the present aspect, reset or correction of the estimated phase point can be executed during blank imaging time TC, even when the process is in the middle of imaging time TA. Thereby, the error in the estimated phase point may be cleared earlier (i.e., before the next non-imaging time TB), according to the circumstances. Consequently, the effects of variation in rotational speed of the photoconductor 33 on image quality can be suppressed more adequately.

(4) In the present aspect, the change characteristics information is provided individually for the respective colors (i.e., for the respective photoconductors 33). Therefore, scanning line interval correction for an image of each color is accurately performed based on proper change characteristics information. Consequently, the effects of variations in rotational speeds of the photoconductors 33 on quality of the resultant color image can be adequately suppressed.

However, in the case that some of the photoconductors 33 have similarities or a relationship in their rotational behavior, common change characteristics information may be used for the photoconductors, as described below.

Another illustrative aspect will be explained with reference to FIGS. 10 and 11. This aspect differs from the above previous illustrative aspect in the number of shifting phase points at which reset of the estimated phase point can be executed during each cycle. That is, in addition to the detecting phase point P(0), a virtual phase point P(K) pre-selected from the phase points P(1) to P(M) is used as another shifting phase point at which resetting or correction of the estimated phase point can be executed during each cycle, in the present aspect.

The other constructions are similar to the previous aspect, and therefore are designated by the same reference numerals. Redundant explanations are omitted, and the following explanation will be concentrated on the difference.

In the previous aspect, the length of non-imaging time TB between pages is set to be longer than the detecting time interval TD (See FIG. 8). In contrast, referring to FIG. 10, the length of non-imaging time TB between pages is set to be shorter than the detecting time interval TD, in the present aspect. Therefore, the detecting phase point P(0) will not necessarily be reached during every non-imaging time TB.

In view of this, the virtual phase point P(K) is additionally used as a shifting phase point at which reset or correction of the estimated phase point can be executed, in the present aspect. Two or more phase points within a cycle may be selected as additional shifting phase points. However, in the preset aspect, the virtual phase point P(K) is solely used as an additional phase point.

Specifically, a phase point coming just halfway between the detecting phase points P(0) is selected as the virtual phase point P(K), in the present aspect. The measured time interval between the detecting phase point P(0) and the virtual phase point P(K) (hereinafter, referred to as "a virtual time TE") is approximately equal to the half of the detecting time interval TD, as shown in FIG. 10.

The process before reset of the estimated phase point according to the present aspect is similar to that of the previous aspect. FIG. 11 shows the process for reset of the estimated phase point according to the present aspect. In FIG. 11, steps similar to steps of the previous aspect are designated by the same symbols as FIG. 7, while the other steps are designated by different symbols.

When the current phase of the photoconductor 33 is reaching the virtual phase point P(K), it is determined at step S11 that the detection flag F is not set to 1 (i.e., "NO" is determined at step S11), and therefore the process proceeds to step S41.

At step S41, it is determined whether the virtual time TE has just elapsed since actual detection of the detecting phase point P(0). The CPU 77 starts count of the elapsed time using the internal clock, when the origin sensor 73 has detected the detecting phase point P(0). Whether the virtual phase point P(K) has been reached is determined at step S41 based on the counted elapsed time.

The photoconductor 33 now reaches the virtual phase point P(K) as described above, and therefore "YES" will be determined at step S41. Then, the process proceeds to step S23.

If the present process is in the middle of neither non-imaging time TB nor blank imaging time TC (i.e., if "NO" is determined at both of steps S23 and S25), the process proceeds to step S13 after the detection flag F is cleared at step S37. Then, steps S13 to S21 are executed similarly to steps S13 to S21 of the above aspect 1.

That is, the correction difference ΔD(N) is retrieved from the change characteristics information, based on the estimated phase point P(N) without being corrected. The write time interval T1 is corrected using the retrieved correction difference ΔD(N), and one line scanning is started when count of the corrected write time interval T1 is completed.

Thus, even when the virtual phase point P(K) has been reached, reset or correction of the estimated phase point is skipped during nonblank imaging time, so that degradation of image quality due to reset of the estimated phase point can be prevented.

If it is determined at step S41 that the elapsed time since actual detection of the detecting phase point P(0) has not yet reached the virtual time TE or is beyond the virtual time TE (i.e., if "NO" is determined at step S41), the process proceeds to step S13 so that one line scanning is performed during steps S13 to S19 without correcting the estimated phase point.

If it is determined that the present process is in the middle of non-imaging time TB or blank imaging time TC (i.e., "YES" is determined at step S23 or S25) after "YES" is determined at step S41, the process proceeds to step S43 where the CPU 77 determines whether the detection flag F is set to 1.

The photoconductor 33 has just reached the virtual phase point P(K) as described above, and therefore "NO" will be determined at step S43. Then, the process proceeds to step S45.

Assuming that the estimated phase point currently indicates the phase point P(K−5), the Designation Address indicated by the address pointer is forcibly shifted from Address (K−5) to Address (K) at step S45.

At step S47, the write time interval T1(K) corresponding to the virtual phase point P(K), which is equal to (DS+D(K)) or (DS+ΔD(1)+ . . . +ΔD(K)) and is preliminarily stored in the NVRAM 83, is newly assigned to the write time interval T1.

Thus, the write time interval T1 is corrected to be equal to the detecting-point time interval DS plus the correction amount D(K) (i.e., equal to (DS+D (K))). That is, the correction amount D(N) is shifted from D(K−5) to D(K).

At step S33, the CPU 77 counts the corrected write time interval T1 using the internal clock. When the count is completed, the CPU 77 instructs the LED exposure unit 23 to scan one line at step S35. Further, the Designation Address (N) is set to the next Address (K+1). At step S37, it is determined whether the end of the image data has been reached. If "NO" is determined at step S37, the process returns to step S11. If scanning based on the image data associated with the present print job is completed (i.e., "YES" is determined at step S37), the present correction process terminates.

Thus, during the above steps S45, S47 and S33, the estimated phase point is corrected or reset to the virtual phase point P(K). That is, the estimated phase point is shifted to the virtual phase point P(K) and thereby the correction amount is shifted to D(K), when an actual time point (as an initialization time point) corresponding approximately to the virtual phase point P(K) has been reached.

Further, the base time point is reset to the initialization time point (i.e., the actual time point corresponding approximately to the virtual phase point P(K)), so that subsequent estimated phase points can be determined based on a more accurate base time point and count using the internal clock.

The virtual phase point P(K) is an example of "a shifting phase point", and the CPU 77 executing steps S45, S47 and S33 functions as "a shifting portion" of the present invention.

On the other hand, when the origin sensor 73 has detected the detecting phase point P(0) during non-imaging time TB or blank imaging time TC, "YES" is determined at step S23 or S25 after "YES" is determined at step S11. Thereafter "YES" is determined at step S43, and then the process proceeds to step S27.

Steps S27 to S35 are executed similarly to steps S27 to S35 of the previous aspect. Thereby, the estimated phase point is corrected or reset to the detecting phase point P(0). Further, the base time point is reset to an actual time point (as an initialization point) corresponding to the detecting phase point P(0).

Figure 10:
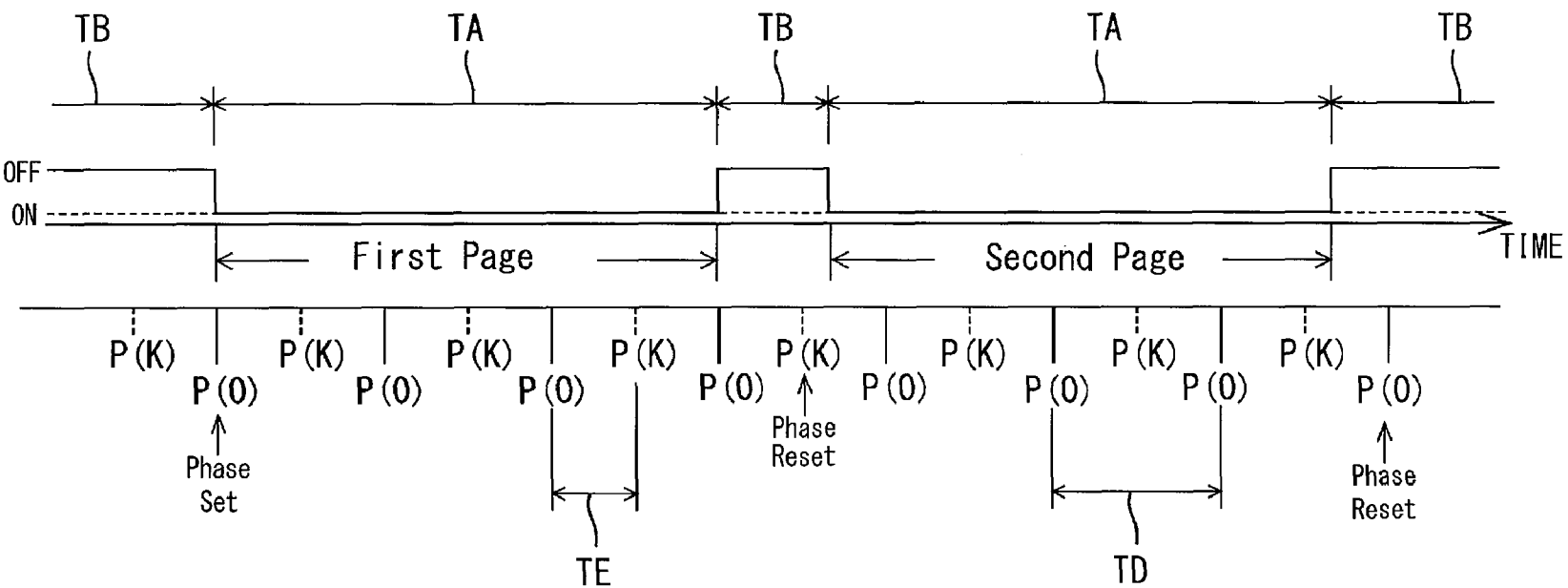
FIG. 10 is a timing chart showing when phase estimation is reset according to another illustrative aspect.
Figure 11:
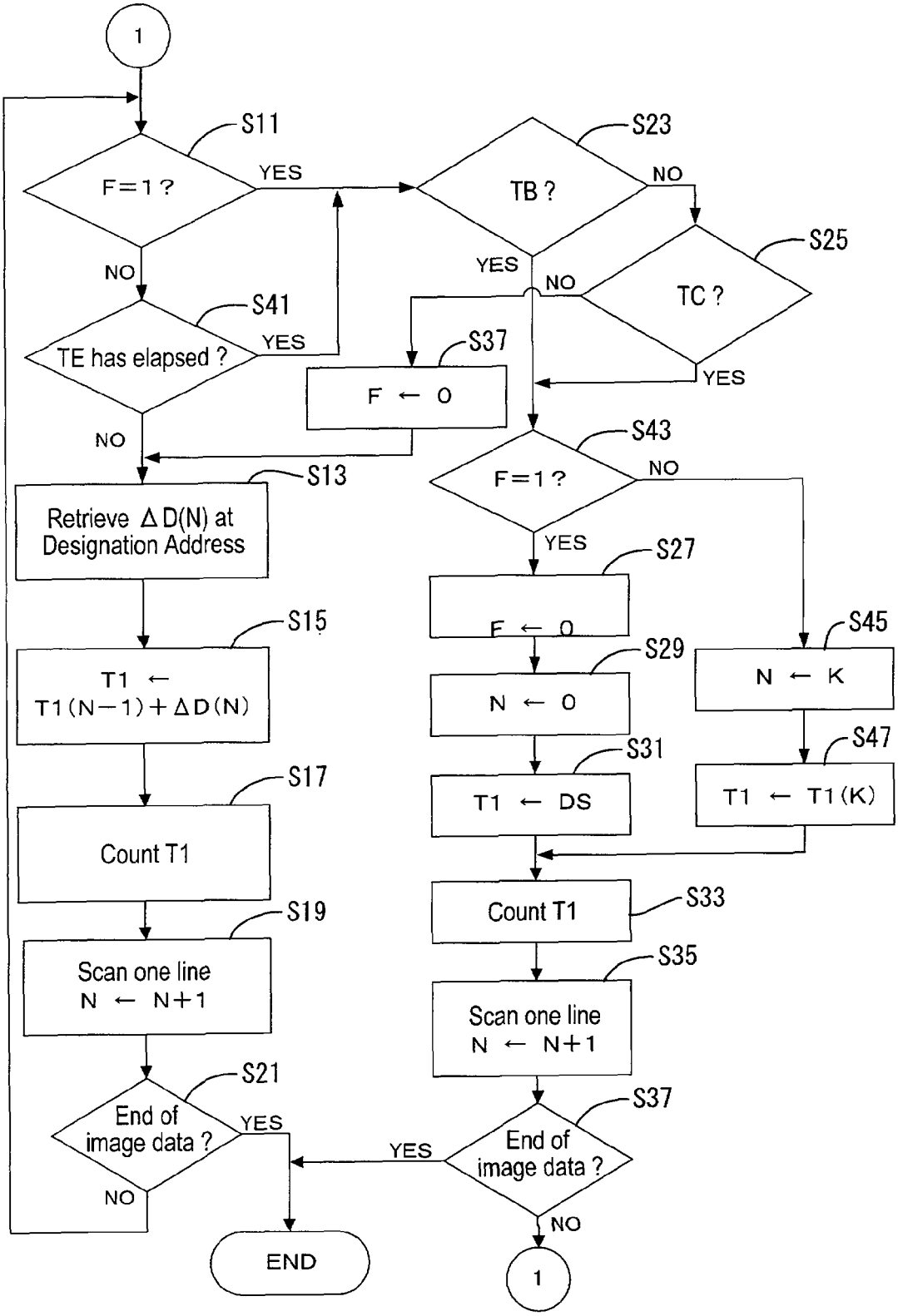
FIG. 11 is a flowchart of the second half of a correction process according to the illustrative aspect.

Thereafter, reset or correction of the estimated phase point is executed, whenever the detecting phase point P(0) or the virtual phase point P(K) has been reached (i.e., whenever an initialization time point has been reached) during non-imaging time TB or blank imaging time TC, as shown in FIG. 10. At the time, the base time point is reset to the initialization time point, so that subsequent estimated phase points can be determined based on a more accurate base time point and count using the internal clock.

If the end of the image data associated with the present print job has been reached when step S35 is completed, the present correction process terminates without returning to step S11.

As can be seen from the above, according to the present aspect, reset or correction of the estimated phase point is executed when the photoconductor 33 has reached the detecting phase point P(0) or the virtual phase point P(K) during inactive time (i.e., during non-imaging time TB or blank imaging time TC).

Therefore, the error in the estimated phase point may be cleared earlier, compared to a construction in which the detecting phase point P(0) is solely used as a shifting phase point. Consequently, the effect of variation in rotational speed of the photoconductor 33 on image quality can be suppressed more adequately.

<Other Illustrative Aspects>

The present invention is not limited to the illustrative aspects explained in the above description made with reference to the drawings. The following illustrative aspects may be included in the technical scope of the present invention, for example.

(1) In the above aspect 2, the detecting phase point P(0) and the virtual phase point P(K) are used as shifting phase points at which the estimated phase point can be corrected during inactive time (i.e., during non-imaging time TB or blank imaging time TC).

However, the present invention is not limited to this construction. The virtual phase point P(K) may be solely used as a shifting phase point at which the estimated phase point can be corrected during inactive time.

(2) In the above aspects, reset or correction of the estimated phase point (executed at a shifting phase point) is allowed during non-imaging time TB or blank imaging time TC.

However, the present invention is not limited to this construction. The reset or correction of the estimated phase point may be allowed only during non-imaging time TB. Alternatively, that may be allowed only during blank imaging time TC.

(3) The length of non-imaging time TB between pages may vary depending on the circumstances. For example, forwarding of a recording medium 7 to the belt unit 21 may be delayed due to delay in processing for developing image data. This could result in a longer non-imaging time TB.

If the printer 1 can operate in a duplex printing mode, the length of non-imaging time TB between pages during duplex printing may differ from that during single-side printing. Further, in the case that the printer 1 is a multifunction printer capable of providing a copy function, a PC-initiated printing function, a fax function and the like, the length of non-imaging time TB between pages may vary depending on the selected function.

Thus, the length of non-imaging time TB between pages can vary depending on the status of the printer 1 (such as the image data processing status, the operation mode, or the selected function). In view of this, both of the correction process as in the above aspect 1 and that as in the above aspect 2 may be used as the situation demands.

That is, the correction process of the aspect 1 (shown in FIG. 7) may be selected for execution, if it is determined based on the status of the printer 1 that the length of non-imaging time TB is currently longer than the detecting time interval TD. The correction process of the aspect 2 (shown in FIG. 11) may be selected for execution, if it is determined that the length of non-imaging time TB is currently shorter than the detecting time interval TD.

(4) In the above aspects, the change characteristics information is stored as a table showing the correspondence relation between the phase point numbers (or Addresses (N)) and the correction differences ΔD (N). However, the change characteristics information may be stored as function representation of the correspondence relation between the phase points and the correction differences ΔD(N).

(5) The change characteristics information stored in the NVRAM 83 is not limited to the correction differences ΔD(N). Instead, the correction amounts D(N) (shown by the dotted line G2 in FIG. 4 or 9) or the rotational speed values of the drive gear 63 (shown by the solid line G1 in the figure) may be stored as change characteristics information in the NVRAM 83.

In the case that the rotational speed values of the drive gear 63 are stored as the change characteristics information, the correction amounts D(N) and/or the correction differences ΔD(N) (to be used for correction of scanning line interval) should be derived from the rotational speed values of the drive gear 63.

(6) In the above aspects, the starting time for each scanning line is adjusted in order to correct the scanning line interval (or image forming position). However, the rotational speed of the photoconductor 33 (as a rotator) may be adjusted instead, in order to correct the scanning line interval.

(7) In the above aspects, an optical transmission sensor is used as the origin sensor 73 for detecting the time when the drive gear 63C has reached the detecting phase point. However, instead of the transmission sensor, an optical reflection sensor may be provided (as "a detecting portion" of the present invention), so that the detecting phase point can be detected based on a light reflected from a reflective mark formed at a predetermined position of the drive gear 63C.

Further, instead of an optical sensor, a magnetic sensor or a contact sensor may be used as the origin sensor 73 for detecting the time when the drive gear 63C has reached the detecting phase point.

In the above aspects, the origin sensor 73 detects when the current phase of the drive gear 63C (provided for driving the photoconductor 33C) has reached the detecting phase point, and thereby indirectly detects when the current phase of the photoconductor 33 has reached the detecting phase point. That is, the sensor as "a detecting portion" indirectly detects the time when the rotator has reached the detecting phase point, by detecting a predetermined status of a drive mechanism provided for driving the rotator.

However, a sensor such as an optical sensor, a magnetic sensor or a contact sensor (provided as "a detecting portion" of the present invention) may be configured to detect a predetermined point on the photoconductor 33C (or rotator), so as to directly detect the time when the photoconductor 33C has reached the detecting phase point.

(8) In the above aspects, the change characteristics information is provided individually for respective colors (or for respective photoconductors 33). However, common change characteristics information may be used for some of the photoconductors 33.

For example, in FIG. 4 of the above aspect, the graph showing the variation of the rotational speed of the drive gear 63K or 63C is symmetrical to the graph showing the variation of the rotational speed of the drive gear 63Y or 63M (that is arranged symmetrical to the above drive gear 63K or 63C with respect to the drive motor 71) with respect to the phase axis.

Therefore, the change characteristics information for one of the drive gear 63K or 63C and the drive gear 63Y or 63M is stored in the NVRAM 83, and the correction amount for the other may be derived therefrom.

(9) In the above aspects, an LED printer of a direct-transfer type is shown as an image forming apparatus. However, the present invention can be applied to an electrophotographic printer of another type such as a laser printer, and further can be applied to a printer of an intermediate-transfer type.

In the case that the present invention is applied to an electrophotographic printer, variation of the forming position of a developer image (or a toner image) due to variation in rotational speed of a rotator (such as a conveyor belt 31, a conveyor roller or a transfer belt) may be corrected by a correction process according to the present invention, contrary to the above aspects wherein variation of the forming position of an electrostatic latent image due to variation in rotational speed of a photoconductor 33 is corrected by a correction process.

For example, in the case that variation of the forming position of a toner image on a recording medium 7 due to variation in rotational speed of a conveyer belt 31 is corrected by a correction process of the present invention, correction amounts to be used for adjusting the scanning line interval during line scanning should be determined based on the measured values of rotational speed of the conveyer belt 31.

The present invention can be also applied to an ink-jet printer or a thermal printer. Further, the present invention may be applied to a printer that uses colorants of two or three colors, or colorants of five or more colors.

In the case that the present invention is applied to an ink-jet printer or a thermal printer, variation of the forming position of an ink image due to variation in rotational speed of a rotator (such as a conveyor roller) can be corrected by a correction process according to the present invention.

What is claimed is:

1. An image forming apparatus comprising:

an image forming portion having a rotator and being configured to form an image on at least one of said rotator and a recording medium traveling with rotation of said rotator;

a storage portion configured to store change characteristics information relevant to correction parameters corresponding to phase points of said rotator;

a designating portion configured to designate a correction parameter from said correction parameters based on said change characteristics information;

a correcting portion configured to correct an image forming position on said at least one of said rotator and said recording medium based on the correction parameter designated by said designating portion;

a detecting portion configured to detect that said rotator has reached a detecting phase point;

a first determining portion configured to determine, based on a time when said detecting portion detects said detecting phase point of said rotator, whether a current phase of said rotator corresponds to a shifting phase point;

a second determining portion configured to determine whether said image forming portion is in inactive time; and a shifting portion configured to shift a designation by said designating portion to the correction parameter corresponding to said shifting phase point, when said first determining portion determines that the current phase of said rotator corresponds to said shifting phase point and said second determining portion determines that said image forming portion is in inactive time.

2. An image forming apparatus as in claim 1, wherein said detecting phase point is used as said shifting phase point.

3. An image forming apparatus as in claim 1, wherein:

said designating portion estimates the current phase of said rotator based on a base time point, and designates the correction parameter corresponding to the estimated current phase based on said change characteristics information; and said base time point is set to a time point corresponding to said shifting phase point, when said shifting portion shifts a designation by said designating portion to the correction parameter corresponding to said shifting phase point.

4. An image forming apparatus as in claim 3, further comprising:

a timer portion configured to measure time;

wherein said designating portion estimates the current phase of said rotator based on said base time point and an elapsed time measured by said timer portion since said base time point.

5. An image forming apparatus as in claim 1, wherein said inactive time includes a time until starting time of image formation associated with a sheet of recording media after ending time of image formation associated with a previous sheet of the recording media.

6. An image forming apparatus as in claim 1, wherein said inactive time includes a blank imaging time during which said image forming portion is engaged in formation of a blank image.

7. An image forming apparatus as in claim 5, wherein said inactive time includes a blank imaging time during which said image forming portion is engaged in formation of a blank image.

8. An image forming apparatus as in claim 2, wherein a virtual phase point other than said detecting phase point is used as said shifting phase point.

9. An image forming apparatus as in claim 5, wherein a length of time until starting time of image formation associated with a sheet of recording media after ending time of image formation associated with a previous sheet of the recording media is set to be longer than a detecting time interval that corresponds to a time until said detecting portion detects said detecting phase point of said rotator after said detecting portion previously detects said detecting phase point of said rotator.

10. An image forming apparatus as in claim 1, wherein:

said image forming portion is configured to form a color image and a monochrome image; and correction of an image forming position by said correcting portion is skipped during formation of a monochrome image.

11. An image forming apparatus as in claim 1, wherein:

said rotator of said image forming portion includes a plurality of rotators provided for respective colors, and said image forming portion is configured to form a color image by forming an image on each of said plurality of rotators; and said change characteristics information stored by said storage portion is provided individually for each of said plurality of rotators.

12. An image forming apparatus as in claim 1, wherein said rotator is a carrier configured to hold a developer image directly or indirectly via a recording medium.

13. An image forming apparatus comprising:

an image forming portion having a rotator and being configured to form an image on at least one of said rotator and a recording medium traveling with rotation of said rotator;

a storage portion configured to store change characteristics information relevant to correction parameters corresponding to phase points of said rotator;

a detecting portion configured to detect that said rotator has reached a detecting phase point;

a processor; and non-transitory storage media storing instructions, which when executed by the processor, cause the processor to:

designate a correction parameter from said correction parameters based on said change characteristics information;

correct an image forming position on said at least one of said rotator and said recording medium based on the correction parameter designated;

determine, based on a time when said detecting portion detects said detecting phase point of said rotator, whether a current phase of said rotator corresponds to a shifting phase point;

determine whether said image forming portion is in inactive time; and shift a designation to the correction parameter corresponding to said shifting phase point, when said first determining portion determines that the current phase of said rotator corresponds to said shifting phase point and said second determining portion determines that said image forming portion is in inactive time.

14. An image forming apparatus as in claim 13, wherein said detecting phase point is used as said shifting phase point.

15. An image forming apparatus as in claim 13, wherein:

said designating includes estimating the current phase of said rotator based on a base time point, and designating the correction parameter corresponding to the estimated current phase based on said change characteristics information; and said base time point is set to a time point corresponding to said shifting phase point, when said shifting shifts a designation by said designating to the correction parameter corresponding to said shifting phase point.

16. An image forming apparatus as in claim 13, wherein said inactive time includes a time until starting time of image formation associated with a sheet of recording media after ending time of image formation associated with a previous sheet of the recording media.

17. An image forming apparatus as in claim 13, wherein said inactive time includes a blank imaging time during which said image forming portion is engaged in formation of a blank image.

18. An image forming apparatus as in claim 13, wherein:

said image forming portion is configured to form a color image and a monochrome image; and correction of an image forming position by said correcting is skipped during formation of a monochrome image.

19. An image forming apparatus as in claim 13, wherein:

said rotator of said image forming portion includes a plurality of rotators provided for respective colors, and said image forming portion is configured to form a color image by forming an image on each of said plurality of rotators; and said change characteristics information stored by said storage portion is provided individually for each of said plurality of rotators.

20. An image forming apparatus as in claim 13, wherein said rotator is a carrier configured to hold a developer image directly or indirectly via a recording medium.

* * * * *